United States Patent [19]

Herfeld

[11] 4,002,325

[45] Jan. 11, 1977

[54] APPARATUS FOR MIXING POWDERY OR GRANULATED MATERIALS

[76] Inventor: Friedrich W. Herfeld, Wall 1, Neuenrade, Germany

[22] Filed: Mar. 22, 1976

[21] Appl. No.: 669,022

[52] U.S. Cl. ..... 259/23; 259/DIG. 17; 259/96; 259/151; 259/155; 34/57 R

[51] Int. Cl.[2] ..... B01F 5/00; B01F 5/16; F26B 17/00

[58] Field of Search ..... 259/1 R, 2, 11, 18, 259/95, 96, 66, 67, 151, 155, DIG. 17, 23; 34/10, 57 R, 57 A, 102, 130, 138; 222/195

[56] References Cited

UNITED STATES PATENTS

| | | | |
|---|---|---|---|
| 994,679 | 6/1911 | Hills | 259/18 |
| 1,613,531 | 1/1927 | Pfisterer | 259/18 |
| 3,563,399 | 2/1971 | Shivers | 34/102 X |
| 3,737,288 | 6/1973 | Hochman | 259/97 X |
| 3,911,594 | 10/1975 | McIntire et al. | 34/57 A X |

*Primary Examiner*—William Price
*Assistant Examiner*—Steven M. Pollard
*Attorney, Agent, or Firm*—Bacon & Thomas

[57] ABSTRACT

The mixing apparatus comprises an ascending pipe within a mixing container narrowing downwards like a funnel as well as an air supply pipe, concentrically provided within the ascending pipe. The ascending pipe ends in the suction space of a radial fan arranged in the lower range of the mixing container. Blast openings of the annular pressure space of the radial fan are directed to the inlet openings of the ascending pipe. The radial fan produces intensive air flow within the ascending pipe which air flow entrains the particles of the materials to be mixed.

14 Claims, 7 Drawing Figures

APPARATUS FOR MIXING POWDERY OR GRANULATED MATERIALS

The present invention relates to an apparatus for mixing powdery or granulated materials, having a mixing container narrowing downwards like a funnel, in the vertical axis of which there are arranged an ascending pipe and concentrically located therein an air supply pipe.

In the case of a prior art mixing apparatus of this type in accordance with German Pat. No. 902,929 air is fed through the air supply pipe which extends through the cover wall of the mixing container downwards and flows out at the bottom end of the air supply pipe. The air flows upward in the annular space between the outer wall of the air supply pipe and the inner wall of the ascending pipe and carries away a portion of the materials to be mixed. The air flow within the bottom part of the mixing container should reach a space range as large as possible so that the materials to be mixed are properly entrained. It is of disadvantage that for the mixing apparatus larger structures for the circulation of the fluid are necessary above the head wall of the materials to be mixed.

Also in the case of other mixing apparatuses of this kind, a suction pipe and an air supply pipe extend from the interior of the mixing container to the outside. A pressure fan feeds the air from the suction pipe and delivers the air through the air supply pipe into the interior of the mixing container. These structures outside of the mixing container are very disadvantageous.

Object of the present invention is such a provision of a mixing apparatus of the type as stated that an air flow as advantageous as possible is achieved taking place in the interior space of the mixing container to a large extent.

According to the present invention this object is solved in that the air supply pipe extends into the suction space of a radial fan located in the bottom region of the mixing container, and that blast openings of the annular pressure space of the radial fan are directed to the inlet opening of the ascending pipe.

In the case of the mixing apparatus according to the present invention a radial fan is located in the bottom region of the mixing container, where same can be included directly in the construction of the mixing container. Regarding the flow the radial fan is placed very favorably because the air supply pipe may be connected in the direction of the fan axis. The pressure space of the radial fan, via blast openings, presses air into the lower zone of the mixing container immediately in the direction to the ascending pipe. This air stream loosens up the materials to be mixed in the lower range and thereby secures uniform entraining within the annular ascending pipe. Consequently, any unmixed region cannot be formed in the lower part of the mixing container.

For the adjustment of the rate of flow and, thus, of the mixing action and mixing effect, it is proposed by the present invention to provide an adjusting device for the opening and the closing of the blast openings.

Moreover, it is arranged that the wall of the air supply pipe comprises a conical enlargement in the region projecting from the ascending pipe. Thus, the conical outer wall forms a deflection face for the materials to be mixed, carried away into the annular space of the ascending pipe. The funnel, open to the top, of the air supply pipe serves as suction opening.

According to a further embodiment of the present invention it is proposed that the air supply pipe comprises on the lower side a funnel-shaped tapered wall which, simultaneously, is the end wall of the pressure space, and that a conical wall of the inlet opening of the ascending pipe surrounds the funnel-shaped end wall of the pressure space whereby the two funnel walls are opposite to the lower wall of the mixing container whereby an annular gap is formed.

In the case of this embodiment, air is blown into a funnel-shaped annular gap for the ascending pipe so that complete and reliable entraining of the materials to be mixed is secured.

In compliance with a modified embodiment of the present invention it is proposed that the air supply pipe extending approximately to the top end of the ascending pipe terminates in an air suction filter having such openings which favor a separation of materials to be mixed and air.

At the lower end of the air supply pipe a conical wall enlarging downwards is provided, improving the feed of the maerials to be mixed to the mouth of the ascending pipe.

The mixing apparatus of the present invention is also adapted for the drawing in of the materials to be mixed from a material storage hopper in such a manner that an air pipe is connected to the pressure space of the radial fan which ends into a jacket pipe of a material supply funnel, and that within the jacket pipe a feed line is provided which leads into the mixing container.

The air stream may be reoriented by means of the adjusting device for the blast openings.

Embodiments of the present invention will be described in the following with reference to the attached drawing, in which:-

Figure 1:
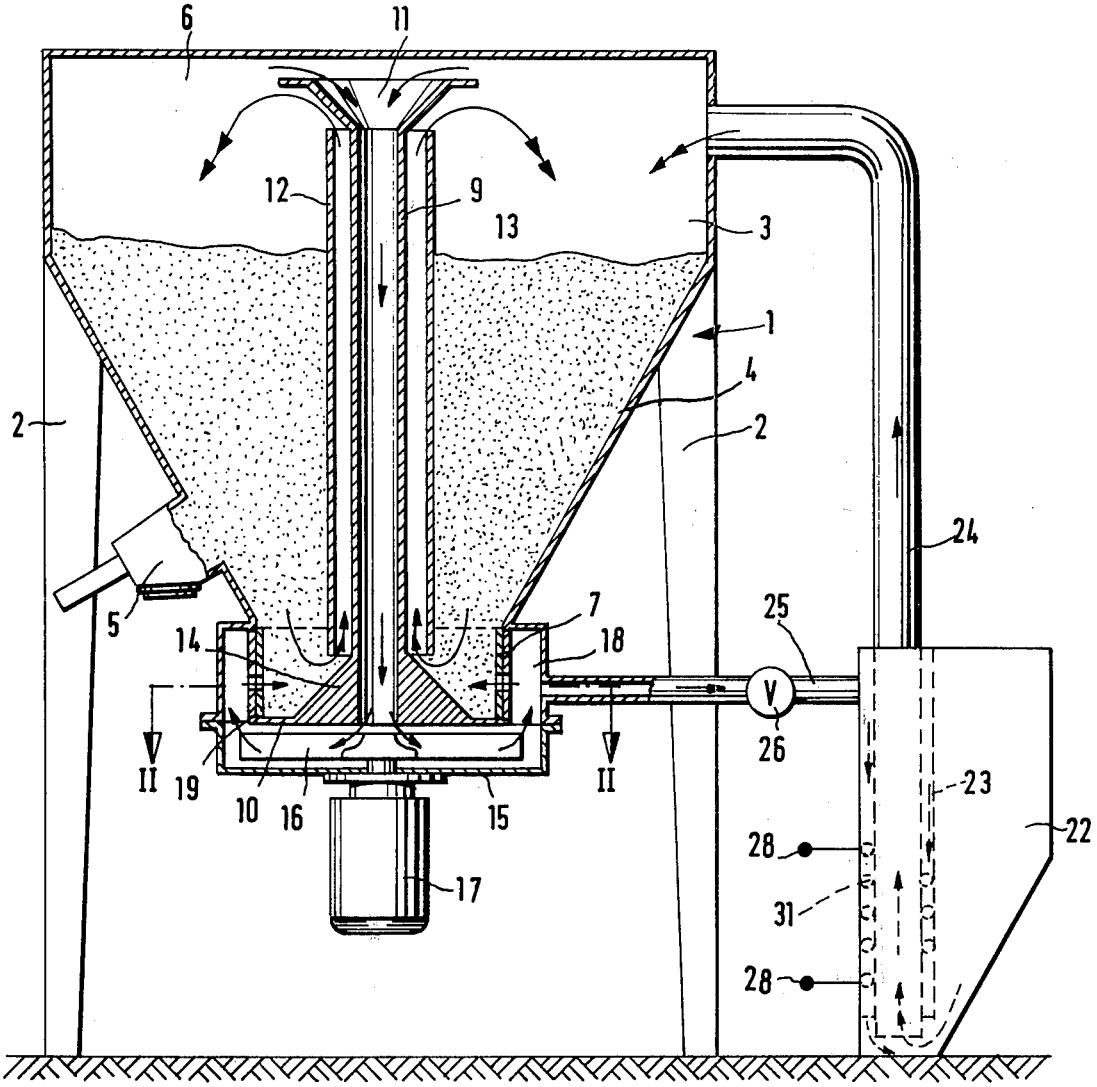
FIG. 1 is a mixing apparatus according to the invention in a schematic section.

A mixing container 1 is located on supporting legs 2. To an upper cylindrical container portion 3 follows a container portion 4 tapered downwards like a funnel, in the side wall of which there is provided an outlet slider 5. On the upper side, the mixing container 1 is closed by a cover wall 6 which may be provided with a closure, not shown, for cleaning and maintenance purposes. The container portion 4 changes to a root portion 7. The circumferential wall of this root portion 7 comprises, uniformly distributed, blast openings 8.

In the axis of the mixing container 1, there is arranged an air supply pipe 9 which extends through the bottom wall 10 of the mixing container. At the top end, the air supply pipe 9 has a conical enlargement 11, the end face of which is situated not far below the cover wall 6. The air supply pipe 9 is surrounded by an ascending pipe 12 for a large portion of its length so that between the air supply pipe 9 and the ascending pipe 12 an annular duct 13 is formed. At the bottom end of the air supply pipe 9, below the port of the ascending pipe 12, there is a conical wall 14 enlarging downwards. Below the bottom wall 10 there is provided a housing 15 which by its vertical axis includes rotor 16 of a radial fan. The rotor 16 is driven by the shaft of a motor 17. The pressure space 18 of the radial fan is shaped as an annular space which encloses the root portion 7 of the mixing container 1. At the outside of the circumferential wall of the root portion, there is an annular slide 19 having passages 20 which are alignable with the blast openings 8. A setting device 21 allows adjustment of the annular slide 19 and, thus, adjustment of the flow through the blast openings 8.

A material feeding hopper 22 contains a shell pipe 23 as well as, coaxially within the shell pipe, a feeding line 24 which opens into the upper container portion 3. From the annular space 18 an air pipe 25 leads into the shell pipe 23. The air pipe 25 contains a throttle valve 26 or a gate-type shut-off valve.

Figure 2:
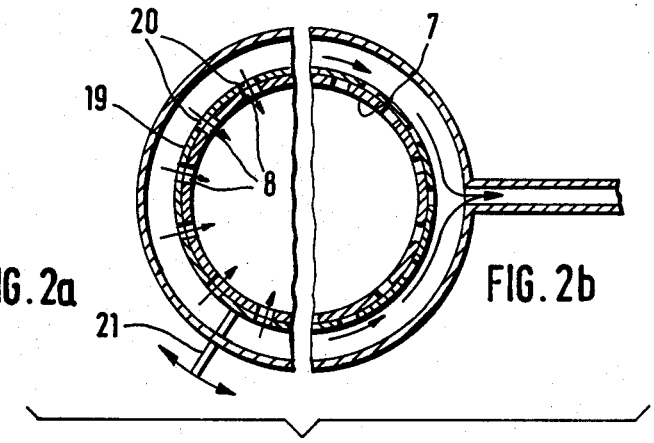
FIG. 2 is a plan view along line II—II in FIG. 1.

In FIG. 1 the air flow is shown by lines having one arrowhead each, and the flow of the materials to be mixed is shown by lines having two arrowheads each. FIG. 2 shows different settings of the annular slide 19, in the left and right half of the Figure. The right half of FIG. 2 shows a setting of the annular slide 19 where the blast openings 8 are closed. In this working condition it is, of course, necessary that the throttle valve 26 is open. Then the rotor 16 of the radial fan presses air from the annular space 18 through the air pipe 25 into the shell pipe 23. At the lower end of the shell pipe 23 the air flows into the feeding line 24 and thereby entrains material from the material feeding hopper. This material is fed into the upper portion 3 of the mixing container and then fills the mixing container in the manner as shown. After appropriate filling the throttle valve 26 is closed and the annular slide 19 is adjusted to the position as shown in the left half of FIG. 2 so that now the radial fan presses air through the blast openings 8. This air loosens up the materials to be mixed within the root portion 7 of the mixing container and flows into the annular duct between the ascending pipe and the air supply pipe. Thereby materials to be mixed are entrained. The enlargement 11 redirects the flow and, above all, the particles of the materials to be mixed so that same fall downwards within the mixing container. In the mouth of the enlargement 11 air is drawn in.

Figure 3:
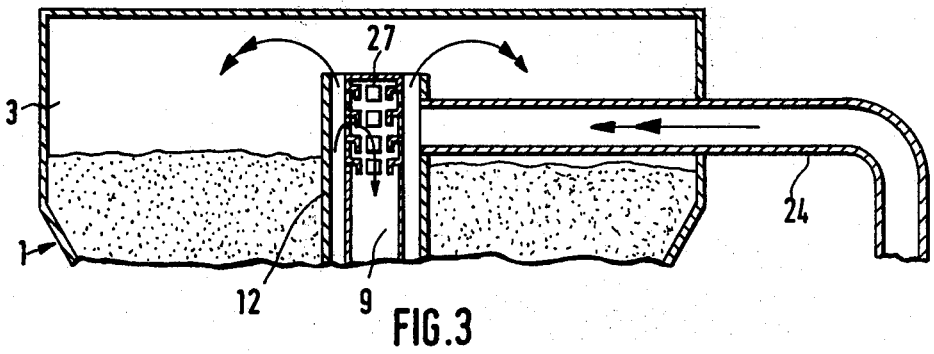
FIG. 3 is a modified embodiment of the upper portion of the mixing container.

FIG. 3 shows a modified embodiment of the air supply pipe 9. The air supply pipe 9 is closed at its upper end by an air suction filter 27. The openings thereof are provided in such a manner that they improve the separation of the materials to be mixed and air. Furthermore, this mixing container is equipped in the same manner as the mixing container of FIG. 1.

The feeding line 24 may lead through the wall of the mixing container 1 to the ascending pipe 12. In this case the charge material is immediately entrained in the ascending pipe and is distributed in the interior space of the mixing container so that any agglomeration is avoided.

In the annular space between the shell pipe 23 and te outside of the feeding line 24 a heating means 31 may be provided which, via connections 28, is fed with a heating medium. It may be an electrical heating. This heating means 31 serves for the heating of the air and, thus, for the drying of the materials to be mixed. Optionally, or additionally, a heating body may also be included in the air supply pipe 9, in the air pipe 25 and/or in the annular space 18. A heating in the annular space 18 renders possible heating of the air in the normal mixing operation.

Figure 4:
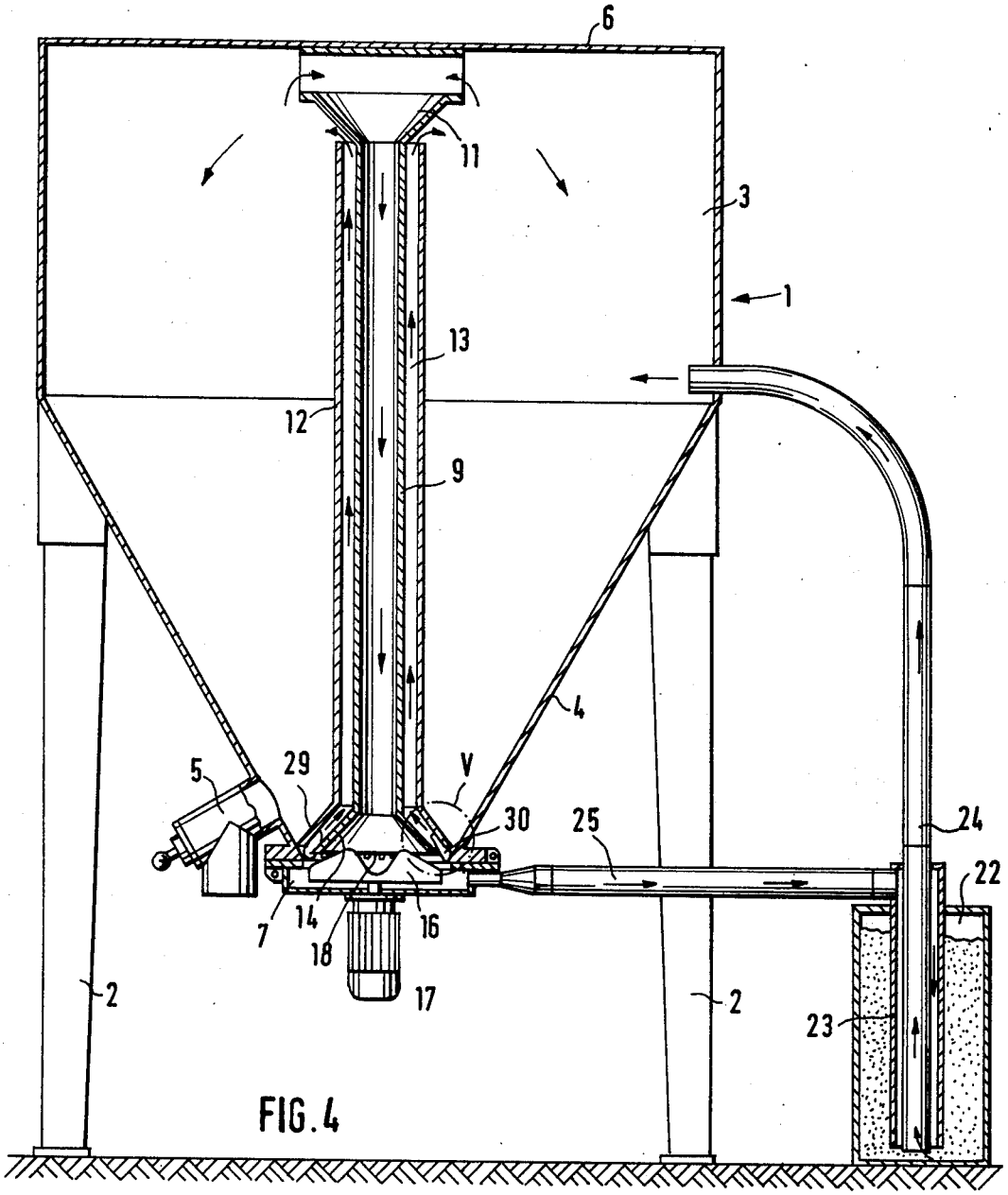
FIG. 4 is a modified embodiment of a mixing apparatus in a schematic section.
Figure 5:
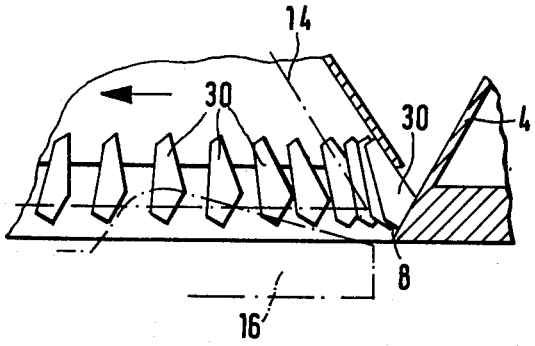
FIG. 5 shows sector V in FIG. 4 on an enlarged scale.

Regarding the embodiment of the present invention, as shown in FIGS. 4 and 5, the pressure space 18 is situated below the conical wall 14 of the air supply pipe 9. Between the end edge of conical wall 14 and the wall of the container portion 4, an annular gap-type blast opening 8 remains free. At the lower end of the ascending pipe 12, there is also a funnel-shaped conical wall 29 so that a funnel-shaped annular gap is formed as an inlet opening for the ascending pipe 12. At the conical wall 29, there are provided guide vanes 30 which are supported on the wall of the container portion 4 and, thus, project into the annular blast opening. This is particularly evident from FIG. 5, wherein the inner conical wall is shown in dot-dash lines, in order to enable a more accurate illustration of the guide vanes 30. The guide vanes 30 are set opposite to the direction of rotation of the rotor 16; thereby the air is deviated and introduced into the annular inlet gap of the ascending pipe 12. Thereby, on the side of the guide vanes not blown against, there is produced a lower air pressure than on the side of the guide vanes blown against. Consequently, the materials to be mixed are sucted in within this low-pressure region and are entrained. Moreover, the function and operation of this mixing device is evident immediately from the above description.

What is claimed is:

1. Apparatus for mixing powdery or granulated materials, comprising a mixing container narrowing downwards like a funnel, an ascending pipe placed in the vertical axis thereof, an air supply pipe concentrically provided within the ascending pipe, a radial fan situated in the root portion of the mixing container, whereby the air supply pipe extends into the suction space thereof, and the annular pressure space of which containing blast openings which are directed on to the inlet opening of the ascending pipe.

2. Apparatus in accordance with claim 1, wherein the pressure space of the radial fan is provided as an annular space which encloses the root portion of the mixing container.

3. Apparatus in accordance with claim 2, wherein at the lower end of the air supply pipe below the mouth of the ascending pipe there is provided a conical wall enlarging downwards.

4. Apparatus in accordance with claim 1, wherein an adjusting device is provided for the opening and closing of the blast openings.

5. Apparatus in accordance with claim 3, wherein the adjusting device is provided as an annular slide which surrounds the circumferential wall of the root portion of the mixing container.

6. Apparatus in accordance with claim 1, wherein the air supply pipe comprises at the lower end thereof a funnel-shaped conical wall which, simultaneously, is the end wall of the pressure space, and wherein a conical wall of the inlet opening of the ascending pipe surrounds the funnel-shaped end wall of the pressure space, whereby the two funnel walls are opposite to the root wall of the mixing container, whereby an annular gap is formed.

7. Apparatus in accordance with claim 6, wherein in the region of the annular gap guide vanes are provided which are set opposite to the direction of rotation of the fan rotor.

8. Apparatus in accordance with claim 1, wherein the wall of the air supply pipe comprises a conical enlargement in the range projecting from the ascending pipe.

9. Apparatus in accordance with claim 1, wherein the air supply pipe, extending approximately to the top end of the ascending pipe is closed is closed by an air suction filter having such openings which show a favorable effect in regard to the separation of the materials or substances to be mixed and the air.

10. Apparatus in accordance with claim 1, wherein an air pipe is connected with the pressure space of the radial fan which air pipe opens into a shell pipe of a material feeding hopper, and wherein a feeding line is provided within the shell pipe.

11. Apparatus in accordance with claim 10, wherein a throttle valve is placed within the air pipe.

12. Apparatus in accordance with claim 10, wherein the feeding line opens into the upper portion of the mixing container.

13. Apparatus in accordance with claim 10, wherein the feeding line opens into the wall of the ascending pipe.

14. Apparatus in accordance with claim 10, wherein heating means for the heating of the air is provided within the annular space, and/or within the air pipe, or within the shell pipe, or within the air supply pipe.

* * * * *